United States Patent [19]

Bunting

[11] Patent Number: 4,684,787

[45] Date of Patent: Aug. 4, 1987

[54] ARTICLE HEATING CABINET

[76] Inventor: Larry T. Bunting, R.R. 5, P.O. Box 105, Fairfield, Ill. 62837

[21] Appl. No.: 768,245

[22] Filed: Aug. 22, 1985

[51] Int. Cl.[4] ..... A21B 1/00; A21B 1/22

[52] U.S. Cl. ..... 219/400; 34/151; 219/521

[58] Field of Search ..... 219/400, 521; 34/151, 34/239, 240, 243 R

[56] References Cited

U.S. PATENT DOCUMENTS

| | | | |
|---|---|---|---|
| 1,853,061 | 4/1932 | Judelson | 34/240 |
| 2,668,368 | 2/1954 | Jacobs | 34/151 |
| 2,815,585 | 12/1957 | Thompson | 34/151 |
| 2,835,049 | 5/1958 | Jacobs | 34/151 |
| 2,856,700 | 10/1958 | Wales | 34/91 |
| 2,971,266 | 2/1961 | Silva | 34/151 |
| 3,409,996 | 11/1968 | Konstandt | 34/91 |
| 3,827,346 | 8/1974 | Tropp et al. | 219/400 |
| 3,975,833 | 8/1976 | Rothauser et al. | |
| 4,035,927 | 7/1977 | Spiegel | |
| 4,094,076 | 6/1978 | Baslow | |
| 4,117,309 | 9/1978 | Cayley | |
| 4,180,919 | 1/1980 | Baltes | |

*Primary Examiner*—E. A. Goldberg
*Assistant Examiner*—Lincoln Donovan
*Attorney, Agent, or Firm*—John E. Reilly

[57] ABSTRACT

A device for warming or heating an article includes a rack in the form of a hollow shell mounted for movement into a warming chamber of a cabinet. The article is draped over the rack and hangs over vents formed in the rack. A blower in the cabinet directs hot or warm air through the hollow rack, so as to pass through vents into one side of the draped article to warm the article both by conduction through the walls of the rack and by convection through the vents and by passage around the outside of the article.

10 Claims, 4 Drawing Figures

ARTICLE HEATING CABINET

This invention relates generally to a device for warming or heating articles and more particularly to a novel and improved cabinet for heating articles, such as, towels and the like in a reliable efficient manner.

BACKGROUND AND FIELD OF THE INVENTION

It is desirable to provide in bath or shower room areas for a rapid, convenient means for the uniform heating of articles, such as, clothing or towels and the like as a preliminary to use. For example, in taking a bath or shower, a heating device or unit should be capable of heating or warming uniformly through several layers of towel over a period of a few minutes in order to at least warm the towel and in some cases remove moisture from the towel as a preliminary to use.

In the case of towel warming, problems arise when the towel is draped over a rod in that the midsection of the towel that is supported by the rod is compressed, rendering it difficult to flow warm air through it. In addition, due to the thickness and construction of towels, heat is not easily conducted through the towel.

Prior art warmers have hung a single section of a towel in front of a blower so that warm air is directed against one side of the towel. Such warmers generally rely on relatively slow heat conduction from one side of the towel to the other side to thoroughly warm the towel. Other warmers have placed a heating element within a perforated support mounted in a housing. In one such warmer, no provision has been made, however, for forcing air to flow over the towel from within the towel support nor around the support within the housing. As a result, the warming is relatively slow even though heat is transferred by convection, conduction and radiation.

Others have suspended towels on hollow rods that are supplied with warm air. The rods have had holes therein to permit air to flow down between pendant sections of the towel that is draped over the rod. In some cases, such rods have been provided with nozzles to increase the flow downwardly between the pendant sections of the towel. Uniform heating of the towel still takes relatively long because there is no controlled air flow over both sides of the towel. Similarly, where holes are provided around the circumference of such rods, the towels are only subject to warm air flow from the inside, which requires a relatively longer period of warming.

Other towel-warming devices have been in the form of racks having rods for hanging draped articles under a hood. A blower mounted in the hood above the articles blows air downwardly over the outsides of the articles. With this relative positioning of the rods and the blower, the hanging article prevents air from flowing against the inside surfaces of the article such that increased time is required to warm the article.

In other variations of units for warming articles, a curtain is hung from a support to surround articles that are hung freely from a bar of the support. A blower-heater below the articles directs warm air upwardly within the curtain across the freely hung articles. Because the articles hang freely from the bar, no provision is made to keep pendant sections of the articles apart nor to assure that the air flows over both sides of or through the articles.

Despite prior efforts to warm articles such as towels, the prior warming devices have operated relatively slowly, because air has been directed only along one side. Further, prior art warming devices have not efficiently directed warm air simultaneously onto the inner and outer surfaces of draped articles in such manner as to force warm air through the midsection that is draped over a support. In addition, prior art warmers that have been provided with doors to permit access to the inside of a chamber have not been provided with racks supported by the door, such that when the door is open the rack has not been presented for easy loading and unloading of the towel.

Representative patents illustrating the foregoing approaches are U.S. Pat. Nos. 2,668,368 to E. N. Jacobs; 2,835,049 to E. N. Jacobs; 2,815,585 to G. S. Thompson; 2,856,700 to N. B. Wales; 2,971,266 to V. G. Silva; 3,409,996 to F. G. Konstandt; 3,975,833 to C. Rothauser et al; 4,035,927 to J. Spiegel; 4,094,076 to F. M. Baslow; 4,117,309 to M. P. Cayley; and 4,180,919 to H. Baltes.

SUMMARY OF THE INVENTION

An object of the present invention is to provide a novel and improved cabinet for directing warm air uniformly against both the inside and outside surfaces of an article therein.

A further object of the present invention resides in the provision of a warming cabinet for the rapid, uniform heating of towels and the like.

A still further object of the present invention is to provide a hollow towel-supporting rack mounted on a door for movement into a warming chamber of a cabinet so as to facilitate warming the inside surface of the towel draped on the rack as well as to supply air that flows outwardly around the rack to simultaneously warm the outer surface of the draped towel.

In accordance with the present invention, a device is provided for heating a thick, fabric article, such as, a towel that resists air flow therethrough and heat transfer thereacross. The device includes a rack having an upper section for supporting a midportion of the article in a draped manner to permit pendant portions of the article to hang downwardly. As draped, the article has an inside surface supported on the upper section of the rack and an outside surface opposite thereto. The weight of the pendant portions of the article is effective to compress the midportion so as to increase the resistance to air flow from the inside surface to the outside surface, while spaced walls of the rack keep the pendant portions apart. The walls of the rack also define a hollow cavity and are provided with vents adjacent the pendant portions and extending through the upper section that supports the midportion of the article. A cabinet is provided having a lower section and an upper, open section. A blower-heater is connected to the lower section for forcing warm air from the lower section into the hollow cavity of the rack so that the warm air flows through the vents and through the inside surface of the article to warm the article from the inside. In the closed position of the door, the door also supports the rack relative to the lower section so that warm air also flows within the warming chamber in passages between the respective article and a rear wall of the warming chamber and the article and the door to warm the article from the outside while the air flows from the rack to the inside of the article. In this manner, not only does warm air penetrate the compressed midportion of the article, but is directed onto both the inside and outside surfaces of the towel to reduce the time required for warming and to more uniformly warm the towel.

BRIEF DESCRIPTION OF THE DRAWINGS

The device of the present invention is described below in connection with the drawings in which.

DETAILED DESCRIPTION OF THE PREFERRED EMBODIMENT

Figure 1:
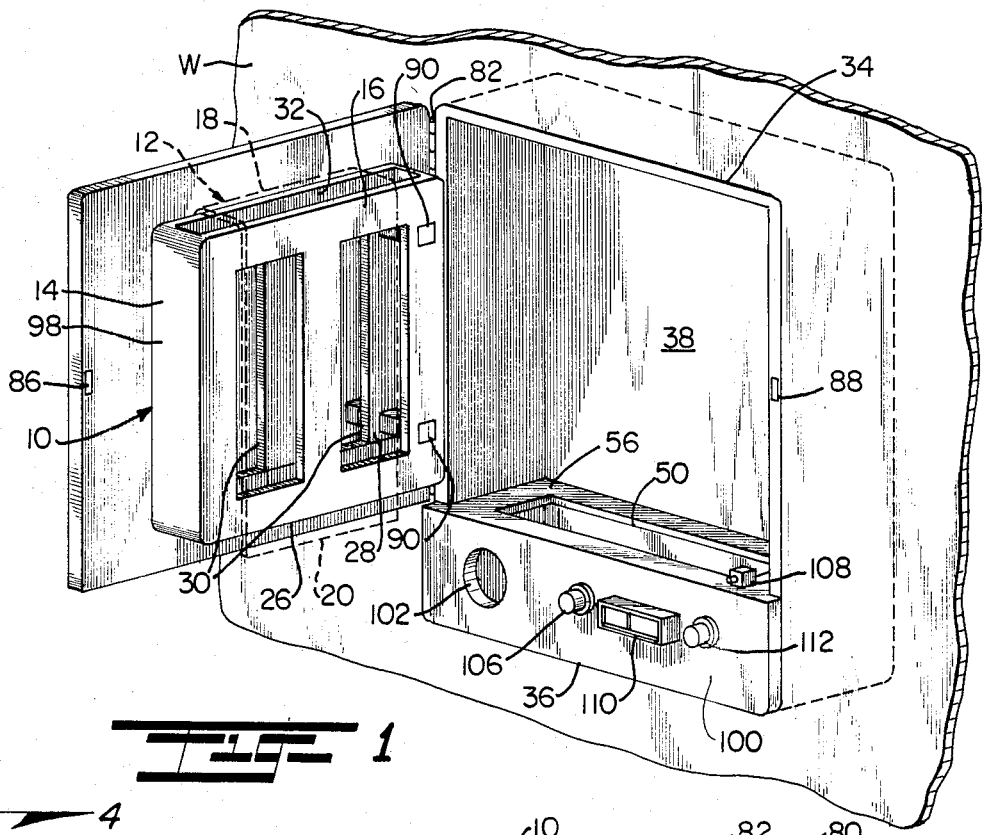
FIG. 1 is a perspective view of a cabinet provided with a door holding a hollow rack for supporting an article to be warmed in the cabinet, the door being shown in the open position.

Referring first to FIG. 1, a device 10 is shown for heating a thick fabric article 12 that resists air flow therethrough and heat thereacross. The device 10 includes a rack 14 having an upper section 16 for supporting a midportion 18 of the article 12 in a draped manner to permit pendant portions 20 of the article 12 to hang downwardly. As draped, the article 12 has inside surfaces 22, shown in FIG. 4, supported on the upper section 16 of the rack 14 and outside surfaces 24 opposite to the inside surfaces 22. The weight of the pendant portions 20 of the article 12 is effective to compress the midportion 18 so as to increase the resistance to air flow from the inside surfaces 22 to the outside surfaces 24.

The rack 14 is preferably in the form of a hollow, generally rectangular shell defined by spaced apart front and rear panels or walls 26 and 28 having laterally spaced vents 30. A vent 32 extends through the upper section 16 that supports the midportion 18 of the article 12.

Figure 2:
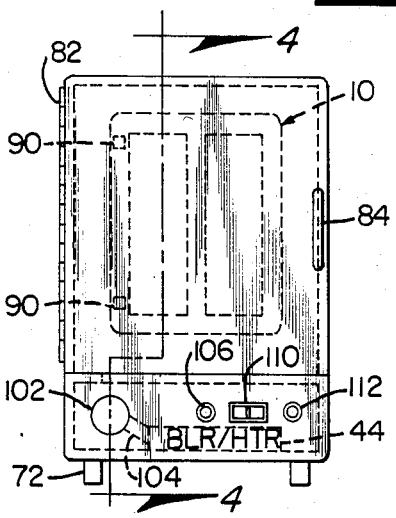
FIG. 2 is a front view of the cabinet shown in FIG. 1 with the door in the closed, heating position and broken away to illustrate a lower section of the cabinet.
Figure 4:
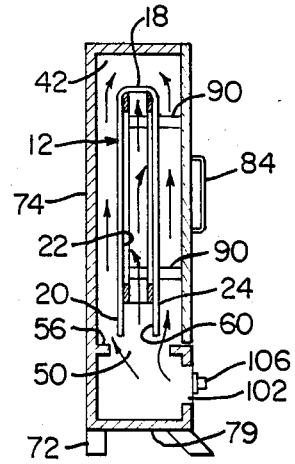
FIG. 4 is a vertical section taken along line 4—4 of FIG. 2 illustrating the door in the closed position to form a warming chamber in which air flows both interiorly of the article that is draped on the rack and exteriorly of the article to warm both sides of the article.

A cabinet 34 is provided with a lower section 36 and an upper open section 38. A door 40 is mounted on the cabinet 34 for closing the upper section 38 to form a warming chamber 42. The door 40 also supports the rack 14 in the warming chamber 42 adjacent to the lower section 36. A blower-heater 44 shown in FIG. 2 is connected to the lower section 36 for forcing warm air from the lower section 36 through slot 50 formed in a partition 56 that separates the lower section 36 from the warming chamber 42. Referring to FIG. 4, the warm air flowing through slot 50 flows outside of the rack 14 and into an area that extends within the heating chamber on each side of the pendant sections 20 of the towel 12 draped on the rack 14 so as to warm the outside surface 24 of the article 12, as well as to flow through an inlet vent 60 formed in a bottom section 62 of the rack 14. The air flows through the inlet 60 into the cavity or shell 26 of the rack 14 and through the vents 30 and 32 onto the inside surfaces 22 of the article 12 and through the article 12 into the warming chamber 42. To some extent, warming occurs as a result of heat conduction through the walls 26 and 28. In this manner, not only does warm air penetrate the compressed midportion 18 of the article 12, but is directed onto both the inside surfaces 22 and the outside surfaces 24 of the article 12 to reduce the time required for warming and to more uniformly warm the article 12.

Figure 3:
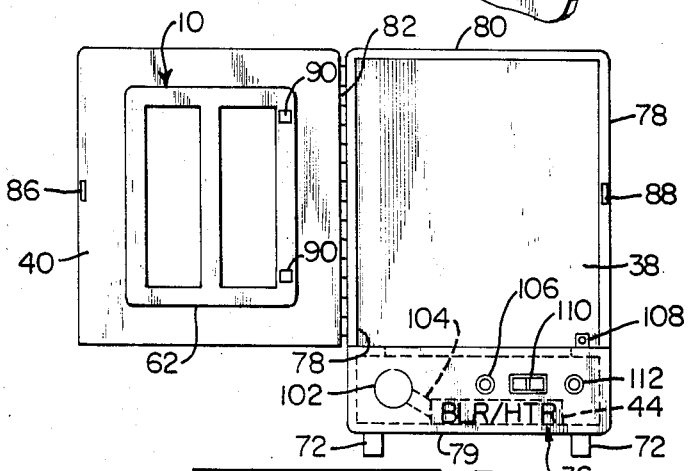
FIG. 3 is a front elevational view of the cabinet showing the door open for receiving an article to be supported on the rack.

Referring now to FIGS. 1, 2 and 3, the cabinet 34 is shown having a bottom wall 79 that may be provided with legs 72 for supporting the cabinet 34 on a countertop (not shown). As illustrated, however, the cabinet 34 is recessed into a wall W. Alternatively, a rear wall of the cabinet 34 may be provided with hooks or other fasteners for securing the cabinet 34 to a vertical support such as a wall W. The cabinet 34 is shown including a rear wall 74 connected to opposite sidewalls 78, a bottom wall 79 and a top wall 80. The walls 74, 78, 79, and 80 cooperate with the door 40 and with the partition 56 to form the warming chamber 42 when the door is in a closed position. The door 40 may be mounted to either of the sidewalls 78 by a hinge 82 for movement from the closed position into an open position to permit draping of the article 12 over the rack 14. To permit such movement, the door is provided with a handle 84, and a latch 86 is secured to the door and cooperates with a complementary latch member 88, shown in FIGS. 1 and 3, to securely keep the door 40 closed during operation of the warming device 10. The dimension of the cabinet 34 between the walls 78—78 may be selected according to the width of the article 12 to be warmed, and the length of the warming chamber 42 between the top wall 80 and the partition 56 is selected to be approximately one half of the length of the article 12 to be warmed.

Referring to FIGS. 1 and 4, the door 40 is shown supporting two vertically spaced posts or brackets 90—90. One side of the rack 14 adjacent to the hinge 78 is mounted on the posts 90—90 such that, as shown in FIG. 4, the walls 28 of the rack include a front wall panel and an opposite rear wall panel spaced from the door 40 and from the rear wall 74 of the cabinet 34 when the door 40 is in the closed position to form the warming chamber 42. The length of the posts 90—90 is selected so that adequate space is provided between the front wall panel and the door 40 for placement of an article to be warmed and so that the air will pass upwardly into the warming chamber 42 along the interior surface of the door 40 and rear wall 74 as well as the interior of the rack 14. In this manner, relatively equal air flow will be provided outside of the rack 14 and along the outside surface 24 of the article 12 as it hangs from the upper section 16 of the rack 14.

As shown in detail in FIGS. 1 and 4, the rack 14 is in the form of a generally rectangular shell or casing and extends for the greater length of the warming chamber 42 between the top wall 80 and the partition 56. The opposite walls 26 and 28 are joined by connecting walls along the bottom 62 and the upper section 16 of the rack 14 and along opposite sides 98 of the rack 14 to form the shell 26. The bottom 62 of the rack is provided with the inlet 60 to permit warm air to flow from the lower section 36, and the front and rear walls 26 and 28 are provided with the elongated vents 30 which extend vertically from the upper section 16 of the rack 14 toward the bottom 62. Alternately, the area of each vent 30 can be made smaller and more vents provided to distribute warm air from the shell 26 onto the inside surfaces 22 of the article 12 and through the article 12 into the area outside of the rack 14.

As shown in FIG. 1, the upper section 16 of the rack 14 is provided with the vent 32. As depicted, the vent 32 is elongated and extends substantially across the width of the rack 14 from opposite sides 98. In a manner similar to the vents 30, the vent 32 formed in the upper section 16 of the rack 14 could be provided in the form of a plurality of smaller vents having smaller cross sectional areas to distribute individual flowstreams of warm air against the inside 22 of the towel and through the compressed midportion 18 of the towel that rests on the upper section 16 of the rack 14.

Referring now to FIGS. 1 to 3 of the drawings, the lower section 36 includes a front wall 100 provided with air inlet 102 that supplies ambient air via duct 104 to the blower-heater 44. The blower-heater 44 can be a conventional device that is electrically powered and that includes a fan and a heating element downstream of the fan for warming the ambient air that enters the lower section 36 via the inlet 102. Electrical power is provided for the blower-heater 44 through a suitable wall outlet, and an "ON/OFF" switch 106 provides electrical power from the source through a control switch 108 and timer 110 to the motor of the blower-heater 44. When the latch 86 is secured to the opposite latch 88 to close the door 40, the switch 108 is closed to condition the circuit so that when the "ON/OFF" switch 106 is pressed and the timer 110 is set to the desired time of warming of the article 12, the blower-heater 44 will operate for the selected period of time. If the user desires to stop the operation of the blower-heater 44 before the end of the timed cycle, a stop switch 112 may be depressed to open the circuit and stop the blower-heater 44. A conventional thermostat, not shown, may be provided in the circuit to automatically cut off the blower-heater 44 if the temperature exceeds a given level.

As shown in FIGS. 1 and 4, when the door 40 is in the closed position, the outlet of the blower 44 discharges warm air upwardly through the lower inlet 60 in the rack 14 and around the outside area 58 surrounding the article to be warmed. The upwardly flowing warm air through the interior of the rack passes outwardly through the vents 30 in the wall panels 28 and the vent 32 in the upper section 16 to warm the article. Additional warming is afforded by the broad surface areas of the wall panels 28 which will conduct heat from the warm air into the article. In this relation, the rack may be suitably composed of metal, plastic or ceramic materials.

In mounting the rack 14 on the inner surface of the door 40, the posts 90 extend in vertically spaced relation through the inside corners of the rack nearest to the hinged section 82 of the door so as to facilitate the lateral insertion or placement of the article to be warmed onto the rack 14. Most desirably, the rack is positioned centrally of the door so that its outer edges are located equal distances from the upper and lower edges and opposite side or vertical edges of the door. In this way, the door can be interchangably mounted to the cabinet with the hinge section extending along either side of the door either for a left-hand or a right-hand opening as required. As shown in FIG. 1, the door is mounted for left-hand opening with the hinge section along the left side of the cabinet. In order to mount the door for a right-hand opening, the door 40 must be rotated through 180° so that the upper vent 32 is reversed with the lower vent 60. For this reason, it is perferable to form the rack so as to be symmetrical and with the upper and lower vents 32 and 60 being readily interchangable or reversible depending upon the left-hand or right-hand mounting of the door.

In the operation of the warming device 10, the handle 84 is used to open the door 40 to expose the rack 14. The article 12, such as a towel having a thick matted construction, is draped over the upper section 16 of the rack 14 and hangs downwardly such that one pendant section 20 hangs between the inside of the door 40 and rear wall, and the other pendant section 20 hangs between the front wall of the rack 14 and the wall of the cabinet 34. The door 40 is then closed to actuate the control switch 108 for conditioning the control circuit for operation. The operator then sets the timer 110 to select a suitable time period, such as five minutes, for warming the towel 12. The switch 106 is then pressed to complete the control circuit and commence the warming operation.

For the time selected, the warm air is caused to flow upwardly through the interior of the rack and around the exterior surfaces of the article to be warmed so as to heat the article on both sides and reduce the time period required for uniform heating or warming of the article. Although, the cabinet has been illustrated in FIG. 1 as being mounted in a recessed portion of the wall W, it will be evident it can be positioned on a counter or floor surface. For this purpose, FIGS. 2 and 3 illustrate the legs 72 to permit placement of the cabinet on a flat surface. The air which is circulated through the cabinet is free to pass outwardly through the space left between the door 40 and cabinet proper. As a suitable alternative, air vents may be positioned in the sidewalls of the cabinet to assist in removal of the warm air.

While the embodiment disclosed above represents a preferred embodiment of the invention, variations thereof will occur to those in the art within the spirit and scope of the invention. Thus, the invention is not to be limited to the particular embodiment described, except as defined by the appended claims.

I claim:

1. An article warming device for warming a thick fabric article of the type which resists air flow therethrough and heat transfer thereacross comprising:

rack means in the form of a unitary hollow shell having spaced apart front and rear panels and connecting end walls and sidewalls between said front and rear panels and including an upper section for supporting the article in a draped manner to permit pendant portions of the article to hang downwardly therefrom wherein the article has an inside surface supported on said upper section and an outside surface opposite thereto, the weight of the pendant portions being effective to compress a midportion of the article to increase the resistance to air flow from the inside surface to the outside surface, said rack means provided with vents extending at least through said top and bottom end walls;

a cabinet having a lower section and an upper open section;

closure means for closing said upper open section to form a warming chamber including means for supporting said rack means in the warming chamber above said lower section; and warm air supply means associated with said lower section for supplying warm air from said lower section into said shell whereby the warm air flows through said shell and said vents therein into contact with the inside surface including the midportion of the article.

2. A heating device according to claim 1, wherein said closure means supports said rack means so that the warm air is directed within said heating chamber along the outside surface of the article to warm the outside of the article.

3. A heating device according to claim 2, wherein: said a partition is mounted between said lower section and said warming chamber, said partition having openings therein for directing warm air to flow from said lower section simultaneously into the bottom end wall of said rack means and along the outside surface of the article.

4. A heating device according to claim 3, said closure means defined by a door in hinged relation to said cabinet, and said rack means having at least one mounting bracket between said rack means and said door on one side of said rack means nearest to the hinged side of the door.

5. A heating device according to claim 4, said warming chamber of the cabinet having rear panel opposite to said closure means, said closure means positioning said rack means and the pendant portions of the article between said closure means and said rear panel to form passages external of the rack means extending along the outside surface of the article, said bottom end wall being provided with an inlet for warm air from said lower section, and a partition between said bottom end wall and said lower section, said partition aligned with said inlet so that warm air from said lower section flows into the inlet and through said vents and flows around the outside of said rack means.

6. A heating device according to claim 5, wherein said closure means is a door mounted for movement relative to the cabinet into an open position for draping of the article on the rack means and into a closed position to close the cabinet, and means responsive to movement of the door into the closed position to condition said warm air supply means for operation.

7. A towel warming device comprising;

housing means having a partition therein dividing said housing means into a first chamber and a second normally open chamber, said partition having a discharge opening to establish communication between said chambers;

closure means for closing said open chamber, said closure means being in the form of a door hinged to one side of said housing means;

rack means, said rack means being in the form of a unitary hollow shell having upper and lower ends provided with vents for the passage of air therethrough and support means for mounting said shell in spaced relation to an inner surface of said door which faces said open chamber when in the closed position, said support means being located toward one side of said rack means relatively near said hinged side of said door with the towel to be warmed being free to be advanced laterally over the opposite side of said rack means to that of said support means so as to be draped over said rack means; and warm air supply means in said first chamber for directing warm air through the discharge opening in said partition into said shell and into an area of said open chamber surrounding said towel to be warmed.

8. A device in accordance with claim 7, wherein said rack means is in the form of a hollow, elongated rectangular shell having spaced apart wall panels connected together by top and bottom walls and opposite sidewalls, said vents formed in said front and rear wall panels and top and bottom walls.

9. A device according to claim 8, wherein; said closure means including a hinge member for interchangable mounting of said closure means in hinged relation to opposite sides of said housing means, said rack means being symmetrically mounted with respect to said door such that said closure means can be rotated through 180° for hinging of said closure means to either side of said housing means with said support means located adjacent to said hinge member in either position of mounting.

10. A heating device according to claim 9, said vents and said bottom wall being aligned with said opening and said partition when said door is moved to the closed position.

* * * * *